United States Patent [19]

Bitonti et al.

[11] 3,943,972

[45] Mar. 16, 1976

[54] SYSTEM FOR CONSERVING COMPRESSED AIR SUPPLY

[75] Inventors: Paul A. Bitonti, Washington, Pa.; John P. Lytle, Troy, Mich.

[73] Assignee: Ross Operating Valve Company, Detroit, Mich.

[22] Filed: Apr. 29, 1975

[21] Appl. No.: 572,898

[52] U.S. Cl. ..... 137/624.11; 137/614.11; 251/16; 91/448; 137/596.17

[51] Int. Cl.[2] ..... F15B 21/08

[58] Field of Search..... 137/624.11, 624.12, 614.11, 137/596.17; 91/446, 448; 251/16

[56] References Cited

UNITED STATES PATENTS 3,729,024 4/1973 Harrah ..... 137/624.13

*Primary Examiner*—Alan Cohan

*Attorney, Agent, or Firm*—Harness, Dickey & Pierce

[57] ABSTRACT

A system for disconnecting a compressed air control system from a main supply line if the system is not used with a predetermined frequency. A normally closed solenoid-operated three-way reset valve is controlled by a normally open hand-operated switch which simultaneously operates a control valve in the system for a working cylinder. When the working cylinder valve is actuated, the three-way valve charges the operating chamber of a normally closed three-way air saver valve in series with the main line, thus opening the air saver valve. The operating chamber of the air saver valve discharges at a controlled rate through the reset valve when the latter returns to its closed position by opening the switch. If the operator closes the switch again before the pressure in the operating chamber is depleted, the air-saver valve is held open. If the switch is not operated in time the system is disconnected from the main line and connected to exhaust by the air saver valve, thus preventing air leakage waste in the system which would otherwise occur if air pressure were maintained.

7 Claims, 2 Drawing Figures

SYSTEM FOR CONSERVING COMPRESSED AIR SUPPLY

BACKGROUND OF THE INVENTION

1. Field of the Invention

The invention relates to compressed air systems in industrial plants. Normally, air from the plant main supply line is continuously applied under pressure to each of the many control valve systems in the plant. A typical control valve system might be for dual acting cylinders which control clamping, piercing or other machine tool operations.

As long as the operator is using the machine, there is no harm in maintaining a constant supply of pressurized air to the machine control valve system. However, if the operator is not at his station for an extended period, for example, during a lunch break or overnight, the continuous application of compressed air through the machine control valve system results in energy wastage by the constant and inevitable leakage from the couplings, joints and valves.

2. Description of the Prior Art

A search on the subject matter of this invention revealed U.S. Pat. No. 3,729,024 wich shows the concept of shutting down a plant when a lubricator is not operating fast enough, the lubricator supplying air to an accumulator. However, the system shown in this patent would be unsuitable for accomplishing the purposes of the present invention and the patent fails to disclose important features as set forth in the attached claims. Another patent, U.S. Pat. No. 1,947,727, exemplifies other systems where, after a given time, a shift is made unless some other action is taken, this patent pertaining to the closure of an elevator door.

BRIEF SUMMARY OF THE INVENTION

It is an object of the present invention to provide a novel and improved system for saving air and thus conserving energy in an industrial plant, which is automatic in its operation, being tied in directly with the frequency of actuation by an operator of a machine, so that a compressed air supply to the control valve system will be shut off and the system connected to exhaust after a given time lapse from the last machine operation.

It is another object to provide an improved system of this character which requires a minimum of additional equipment, is simple and easy to install in an existing system, is adjustable for various time lags, and is extremely reliable in use.

It is a further object to provide an air saving arrangement of this nature which is useful regardless of whether a controlled valve in the system being monitored is held in its shifted position by the operator only momentarily or for an extended period of time.

Briefly, the illustrated embodiment of the invention comprises, in combination with a compressed air control valve system having an air supply line and a solenoid-operated control valve shiftable from a first to a second position by a switch, a three-way normally closed solenoid-operated reset valve, means for simultaneously energizing the solenoid of said reset valve and the solenoid of said control valve, a normally closed three-way air-operated air saver valve having an operating chamber for shifting the valve to its open position, said air saver valve being connected between said air supply line and the inlet port of said control valve, an unrestricted connection leading from the working port of said reset valve to the operating chamber of said air saver valve, and a restricted connection leading from the operating chamber of said air saver valve to the working port of said reset valve.

DESCRIPTION OF THE PREFERRED EMBODIMENT

Figure 1:
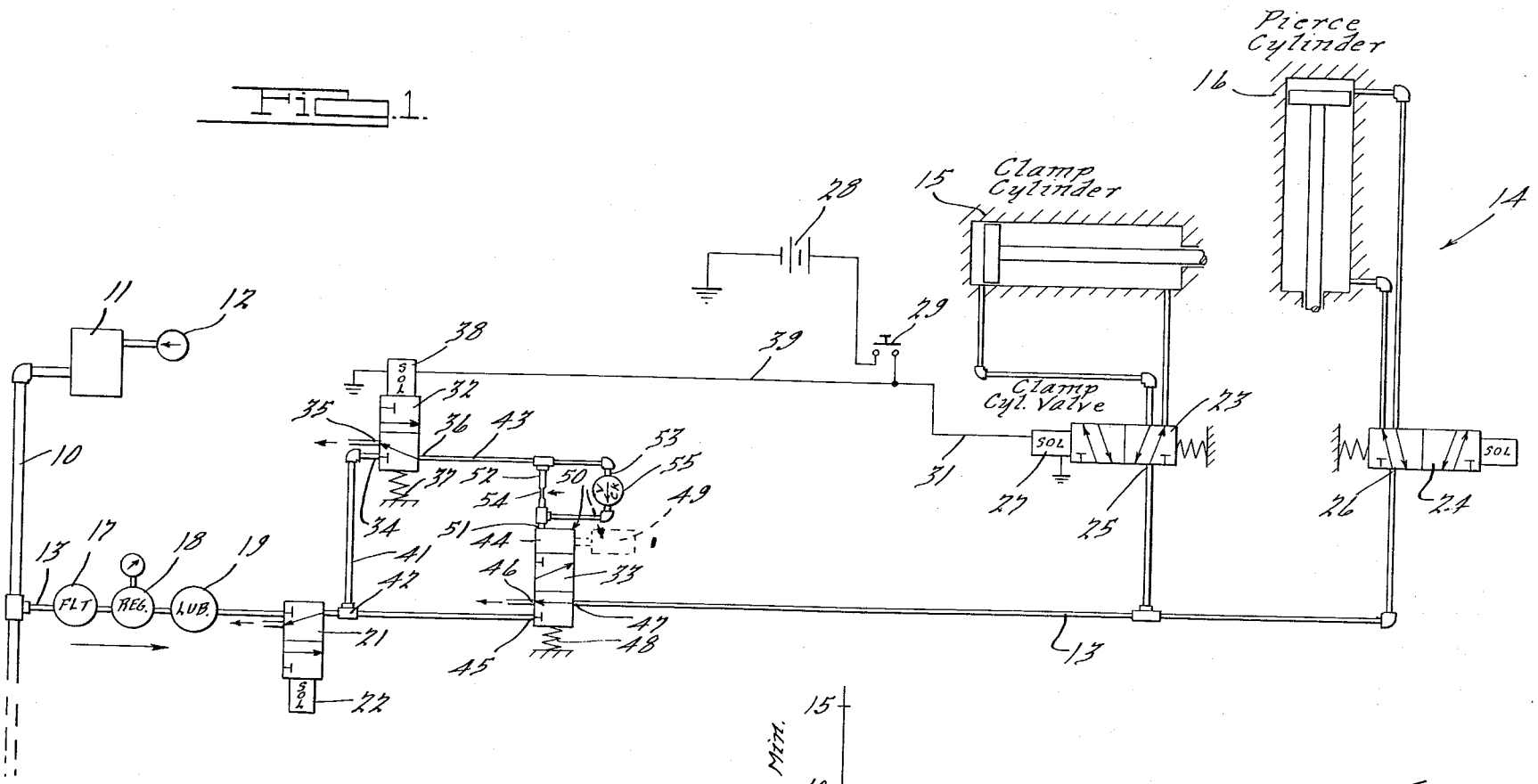
FIG. 1 is a schematic view showing a typical compressed air system for supplying and controlling working cylinders, with the system of this invention incorporated therein.

A main compressed air supply line in an industrial plant is indicated at 10. This line is supplied from a tank 11 pressurized by a compressor 12 and has a number of branches, one of which is indicated at 13. This branch leads to a work station generally indicated at 14 having, for example, a double acting clamp cylinder 15 and pierce cylinder 16 for a press, die or other machine. As is conventional, branch line 13 may be provided with a filter 17, pressure regulator 18 and lubricator 19, as well as a main valve 21. This valve is shown as having a solenoid 22, which when energized, will move the valve from an exhaust position as shown in FIG. 1 to an open position in which compressed air is supplied to station 14.

Branch 13 is illustrated as being connected to a clamp cylinder control valve 23 and pierce cylinder control valve 24. Each of these valves is shown as being a solenoid-operated four-way valve. Valve 23 has an inlet port 25 and valve 24 an inlet port 26, these ports being connected in parallel to supply branch 13. With valves 23 and 24 in their spring-urged positions shown, the piston of cylinder 15 is moved to its left hand position and the piston of cylinder 16 to its upper position. When either valve is shifted by energization of its solenoid, its respective piston will be shifted to the opposite position.

For illustrative purposes, the solenoid 27 of valve 23 only is shown as being connected to an electrical supply source 28. This connection is through a double pole-single throw switch 29 having a connection 31 to solenoid 27. When switch 29 is in its normal open position, solenoid 27 will be de-energized and valve 23 in its left hand position. Momentary or prolonged closure of switch 29 will shift valve 23 to its right hand position, and it will return when switch 29 is released.

The invention comprises a reset valve 32 and an air saver valve 33, the reset valve being connected to switch 29 and the air saver valve in series between valve 21 and work station 14. Reset valve 32 is a solenoid-operated three-way normally closed valve having an inlet port 34, an exhaust port 35 and an outlet or working port 36. The valve is urged by a spring 37 to a normal position in which port 36 is connected to port 35 and port 34 is blocked. A solenoid 38 is provided which, when energized, will move valve 32 to an open position, connecting inlet port 34 to working port 36 and blocking exhaust port 35. Pursuant to the invention, solenoid 38 is connected to push button switch 29 by a conductor 39 in parallel with conductor 31 leading to solenoid 37. Thus, closure of switch 29 will simultaneously energize both solenoids and shift valves 23 and 32 from their positions in FIG. 1. The valves will stay in their shifted positions until push button 29 is released. It will be understood, of course, that push button 29 is merely exemplary of the circuitary used by the operator, which could be controlled by palm buttons or other safety switching equipment.

The compressed air supply for valve 32 is provided by a conduit 41 leading from main branch line 13 at a junction 42 past valve 21. Working port 36 of reset valve 32 is connected by a conduit 43 to the operating chamber 44 of valve 33. This valve is an air-operated normally closed three-way valve having an inlet port 45, an exhaust port 46 and a working port 47. Valve 33 is interposed in line 13 after valve 21 and junction 42. Spring 48 urges valve 33 into a position in which working port 47 is connected to exhaust port 46, thus connecting work station 14 to exhaust and blocking the compressed air in the upstream portion of line 13 from entering the control valve system at the work station.

When chamber 44 is pressurized, it will shift valve 33 to a position connecting the upstream end of line 13 to work station 14 by means of ports 45 and 47, and blocking exhaust port 46. Suitably, an enlarged volume 49 of selected size is provided for chamber 44 so that it will take a predetermined time to exhaust the chambers 44, 49 (referred to in combination as chamber 50) when pressurized air is no longer being supplied thereto. As long as chamber 50 is holding valve 33 in its open position, a full supply of compressed air will be provided for work station 14 so that cylinders 15 and 16 may be operated by valves 23 and 24 respectively.

Conduit 43 leads from working port 36 of valve 32 to the port 51 of operating chamber 50. This connection is through parallel passages 52 and 53. Passage 52 has an adjustable restriction 54 whereas passage 53 has a check valve 55 permitting free and unrestricted flow from port 36 to port 51 but preventing flow in the opposite direction. Flow from port 51 to port 36 must be through adjustable restriction 54.

In operation of the system, assuming that main valve 21 has been opened, the operator at work station 14 will periodically close push button switch 29 to operate clamp cylinder 15. This closure may be momentary or for a prolonged period. Each time the circuit is closed solenoids 38 and 27 will be energized. Solenoid 27 will shift valve 23 to the right in FIG. 1. Solenoid 38 will shift valve 32 downwardly. This will immediately supply air to chamber 50, shifting valve 33 downwardly from its FIG. 1 position. Compressed air will be instantaneously supplied from branch 13 to valves 23 and 24. Valve 23 having been shifted, this air supply will move the piston of cylinder 15 to the right in FIG. 1. The piston of cylinder 16 may be moved appropriately to the desired operation at the work station by other means (not shown).

Should switch 29 be held in its closed position, valves 32 and 33 will continue to be held in their downward or open positions so that compressed air will be supplied to work station 14. When push button switch 29 is released, solenoid 27 will immediately be deenergized, causing valve 23 to move to its FIG. 1 position, thus moving the piston and cylinder 15 to the left.

Figure 2:
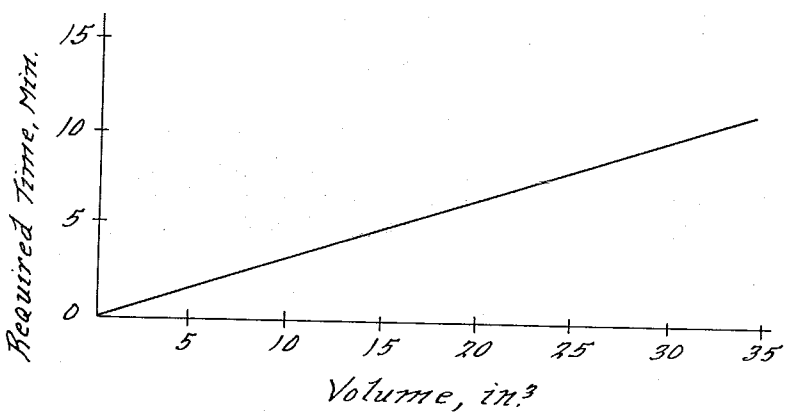
FIG. 2 is a chart showing the variation in non-active time required to cut off the compressed air supply as related to the volume of the air saver valve operating chamber.

Opening of switch 29 will also deenergize solenoid 38 so that spring 37 will move valve 32 to its exhaust position of FIG. 1. Chamber 50 will be depleted through adjustable restriction 54. The time required to reduce the pressure in chamber 50 sufficiently to permit spring 48 to shift valve 33 to its exhaust position will depend upon the setting of restriction 54 and the size of volume 50. FIG. 2 shows a typical relationship between the size of the volume in chamber 50 and the time required, at a given setting of restriction 54, to permit valve 33 to shift to its exhaust position.

Thus, if the operator remains active at work station 29, the volume of chamber 50 and the setting of restriction 44 may be so chosen as to hold valve 33 in its open position for a substantially longer time than the operator would normally take to again close switch 29. This could be, perhaps, ten minutes. As long as the operator closes switch 29 within this time span, solenoid 38 will again be energized (along with solenoid 27) and chamber 50 again pressurized, thus holding valve 33 in its open position and maintaining a full and continuous compressed air supply pressure to working station 14.

However, should the operator leave or become inactive at the station for some reason, such as for lunch or at the end of a shift, valve 33 will shift to its exhaust position at the expiration of said predetermined time period. At that time, line 13 downstream of valve 33 will be connected to exhaust 46, and the upstream end of supply branch 13 will be cut off from the work station. This will prevent any continued wastage of compressed air and thus conserve the energy required to operate compressor 12. Since there could be dozens of work stations similar to station 14 throughout the plant, the installation of this air saving invention at each station could result in a substantial total saving of energy over an extended time period.

When the operator returns, no preconditions need be met before he again operates push button switch 29 as part of his duties at work station 14. Actuation of switch 29 will immediately open valve 33 and supply compressed air to the work station as before.

We claim:

1. In a system for conserving the compressed air supply from a main line to a work station having a control valve, an air saver valve interposed between said main line and said control valve, means normally urging said air saver valve in a position blocking flow from said main line to said control valve, means for selectively shifting said control valve between first and second positions, means responsive to each shifting of said control valve to its second position for shifting said air saver valve from its blocking position to an open position permitting flow from said main line to said control valve, and timing means for permitting said urging means to return the air saver valve to its blocking position after a predetermined time interval in the event that said control valve has not been shifted to its second position during said interval.

2. The combination according to claim 1, further provided with means for holding said air saver valve in its open position as long as said control valve is held in its second position, running of said timing means being initiated in response to shifting of said control valve back to its first position.

3. The combination according to claim 1, said shifting means for the air saver valve comprising an operating air chamber, said timing means comprising a restricted passage leading from said chamber.

4. The combination according to claim 3, said means responsive to shifting of the control valve to its second position comprising a reset valve having a working port connected to said chamber.

5. A system for conserving the compressed air supply from a main line to a work station having a solenoid-operated control valve shiftable from a first to a second position by a switch, comprising a three-way normally closed solenoid-operated reset valve, means for simultaneously energizing the solenoid of said reset valve and the solenoid of said control valve, a normally closed three-way air-operated air saver valve having an operating chamber for shifting the valve to its open position, said air saver valve being connected between said air supply line and the inlet port of said control valve, an unrestricted connection leading from the working port of said reset valve to the operating chamber of said air saver valve, and a restricted connection leading from the operating chamber of said air saver valve to the working port of said reset valve.

6. The combination according to claim 5, said restricted connection being adjustable, said unrestricted connection having a one-way check valve.

7. The combination according to claim 6, said air saver valve being spring-urged toward its closed position, said operating chamber having a fixed volume and an added volume, whereby the size of said added volume may be preselected to determine the required time for permitting said air saver valve to move to its closed position.

* * * * *